United States Patent [19]

Winiasz

[11] Patent Number: 4,535,673

[45] Date of Patent: Aug. 20, 1985

[54] APPARATUS FOR ROTATION OF CARRIERS FOR A STRAND SUPPLY BOBBIN

[75] Inventor: Michael E. Winiasz, Lorain, Ohio

[73] Assignee: James F. Karg, Akron, Ohio

[21] Appl. No.: 673,383

[22] Filed: Nov. 20, 1984

[51] Int. Cl.[3] ..... D04C 3/06; D04C 3/24; D04C 3/38; D04C 3/40

[52] U.S. Cl. ..... 87/29; 87/16; 87/33; 87/44

[58] Field of Search ..... 87/29, 33, 34, 14, 44–48, 87/30, 32, 15–17

[56] References Cited

U.S. PATENT DOCUMENTS

| | | | |
|---|---|---|---|
| 1,493,782 | 5/1924 | Klein | 87/44 |
| 1,707,718 | 4/1929 | Frederickson | 87/44 |
| 1,747,720 | 2/1930 | Krissiep | 87/46 |
| 1,997,211 | 4/1935 | Ford et al. | 87/34 X |
| 3,362,283 | 1/1968 | Dergachev et al. | 87/44 X |
| 3,756,117 | 9/1973 | De Young | 87/29 |
| 4,034,642 | 7/1977 | Iannucci et al. | 87/48 |
| 4,275,638 | 6/1981 | De Young | 87/29 X |
| 4,380,949 | 4/1983 | Betta | 87/48 |

*Primary Examiner*—John Petrakes
*Attorney, Agent, or Firm*—Mack D. Cook, II

[57] ABSTRACT

A drive mechanism for rotating two tables around the central axis stationary shaft of a braiding machine having a set of strand carriers mounted on the rear side of a first table and another set of strand carriers movable around the front side of the first table for rotation by a second table. The drive mechanism is connected to a power input shaft extending substantially parallel to the stationary shaft and toward the rear side of the first table and includes a series of six sprockets, a postshaft and three chains so that the two tables are rotated in opposite directions in response to rotation of the power input shaft.

4 Claims, 5 Drawing Figures

APPARATUS FOR ROTATION OF CARRIERS FOR A STRAND SUPPLY BOBBIN

BACKGROUND OF THE INVENTION

The invention relates generally to an improved strand fabricating machine.

More specifically, the invention relates to an apparatus for rotation of sets of front and rear carriers for strand supply bobbins, in opposite directions around a central axis stationary shaft, by an improved drive mechanism connected to a power input shaft.

A fair description of a strand fabricating machine, also known in the prior art as a braiding machine, is found in U.S. Pat. No. 1,493,782, 1924, Klein. Reference is made "to that type of machine in which two oppositely rotating tables or turrets are provided, each turret or table carrying a series of spools or bobbins, the threads from all of said spools converging at a braiding point above the machine and means being provided whereby the threads from one series of bobbins will be interlaced with the threads from the other series of bobbins. The purpose of machines of this type is to produce a tubular braided fabric with or without a core." (Col. 1, 11. 9–21)

The prior art braiding machines with mechanisms for rotating two tables in opposite directions have generally used differential bevel gear or sun gear-planet gear systems. Such power transmission systems are inherently complex with precisely machined components and similarly complex machine bases, frames or support structures. The Klein patent shows a base 1 mounting a horizontal drive shaft 3 carrying a pulley 4 at its outer end adapted to be engaged by a suitable clutch 5 to connect the driving pulley to the drive shaft. A bevelled driving pinion 6 is mounted on the inner end of the drive shaft and engages two bevelled gears 7 and 8 for rotating the bobbin carrying plates in opposite directions.

Other prior art patents showing the use of differential bevel gear power transmission systems are: U.S. Pat. No. 1,707,718, 1929, Frederickson; U.S. Pat. No. 1,747,720, 1930, Krissiep; and, U.S. Pat. No. 3,362,238, 1968, Dergachev, et al. Prior art patents showing the use of sun gear-planet gear systems are: U.S. Pat. No. 3,756,117, 1973, DeYoung; and, U.S. Pat. No. 4,034,642, 1977, Iannucci, et al. These and other prior art patents relating to braiding machines with two oppositely rotating tables are to be found in Patent Office Class 87.

So far as is known to the inventor, the art relating to braiding machines having two oppositely rotating tables mounted on a central axis stationary shaft has not had a relatively uncomplex drive mechanism connected to a power input shaft for rotating the two tables in opposite directions.

SUMMARY OF THE INVENTION

It is an object of the invention to provide an improved strand fabricating machine.

It is a further object of the invention to provide an improved apparatus for rotation of sets of front and rear carriers for strand supply bobbins, in opposite directions around a central axis stationary shaft, by an improved drive mechanism connected to a power input shaft.

Still further, it is an object to provide a drive mechanism connected to a braiding machine power input shaft which is relatively uncomplex; leading to lower costs of fabrication and efficiencies in operation and maintenance.

These and other objects of the invention, as well as the advantages thereof, will become apparent in view of the drawings and the detailed description.

The invention is used with a braiding machine having a set of rear carriers for a strand supply bobbin mounted on the rear side of a first table for rotation in one direction. The braiding machine also has a set of front carriers for a strand supply bobbin movable around the front side of the first table for rotation by a second table in the opposite direction. The braiding machine has a central axis stationary shaft for rotatable mounting of the first and second tables thereon. The braiding machine also has a drive mechanism power input shaft extending substantially parallel to the stationary shaft and toward the rear side of the first table. The braiding machine also has a frame base carrying a vertically oriented frame stanchion for mounting the stationary shaft and the power input shaft.

A drive mechanism according to the invention, for rotating the first and second tables in opposite directions, has a first sprocket mounted on the forward end of the power input shaft and behind the rear side of the first table. A second sprocket is positioned coaxially around the central axis stationary shaft and aligned with the first sprocket and coupled to the first table. A first chain means connects the first sprocket with the second sprocket so that a rotation of the power input shaft will rotate the first table in one direction. A post shaft extends from the front side of the first table substantially parallel to the stationary shaft and toward the second table. A third sprocket is positioned around the post shaft on the medial portion thereof and rotatable thereon. A fourth sprocket is positioned around the post shaft on the end thereof, and coupled to the third sprocket for rotation therewith. A fifth sprocket is positioned around the stationary shaft and coupled thereto and aligned with the third sprocket. A second chain means connects the third sprocket with the fifth sprocket so that the third sprocket is rotated in a second direction during rotation of the first table in the opposite direction. A sixth sprocket is positioned around the stationary shaft and aligned with the fourth sprocket and coupled to the second table. A third chain means connects the fourth sprocket with the sixth sprocket so that the fourth sprocket, coupled to the third sprocket and the second table, are rotated in a second direction during rotation of the first table in the opposite direction.

IN THE DRAWINGS

DETAILED DESCRIPTION OF THE INVENTION

Figure 1:
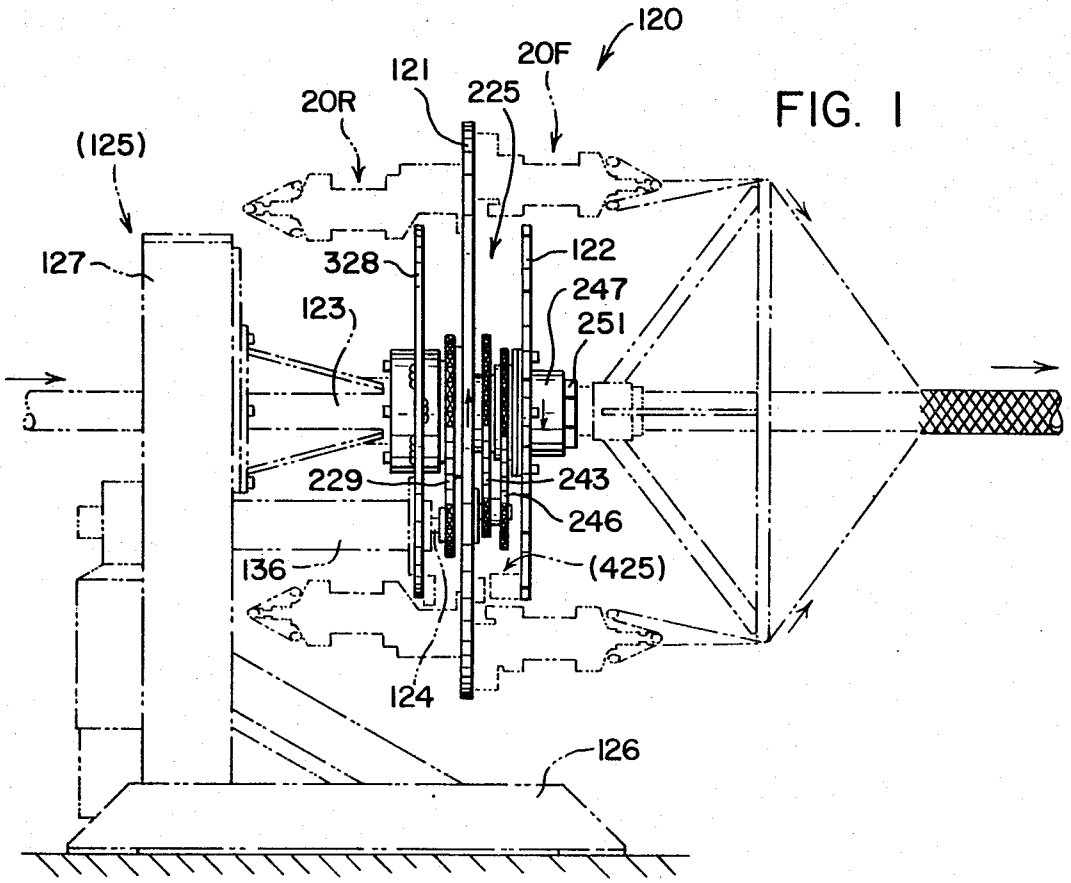
FIG. 1 is a side view of a braiding machine showing the table drive mechanism according to the invention in full lines, other components of the braiding machine being shown in chain lines.
Figure 2:
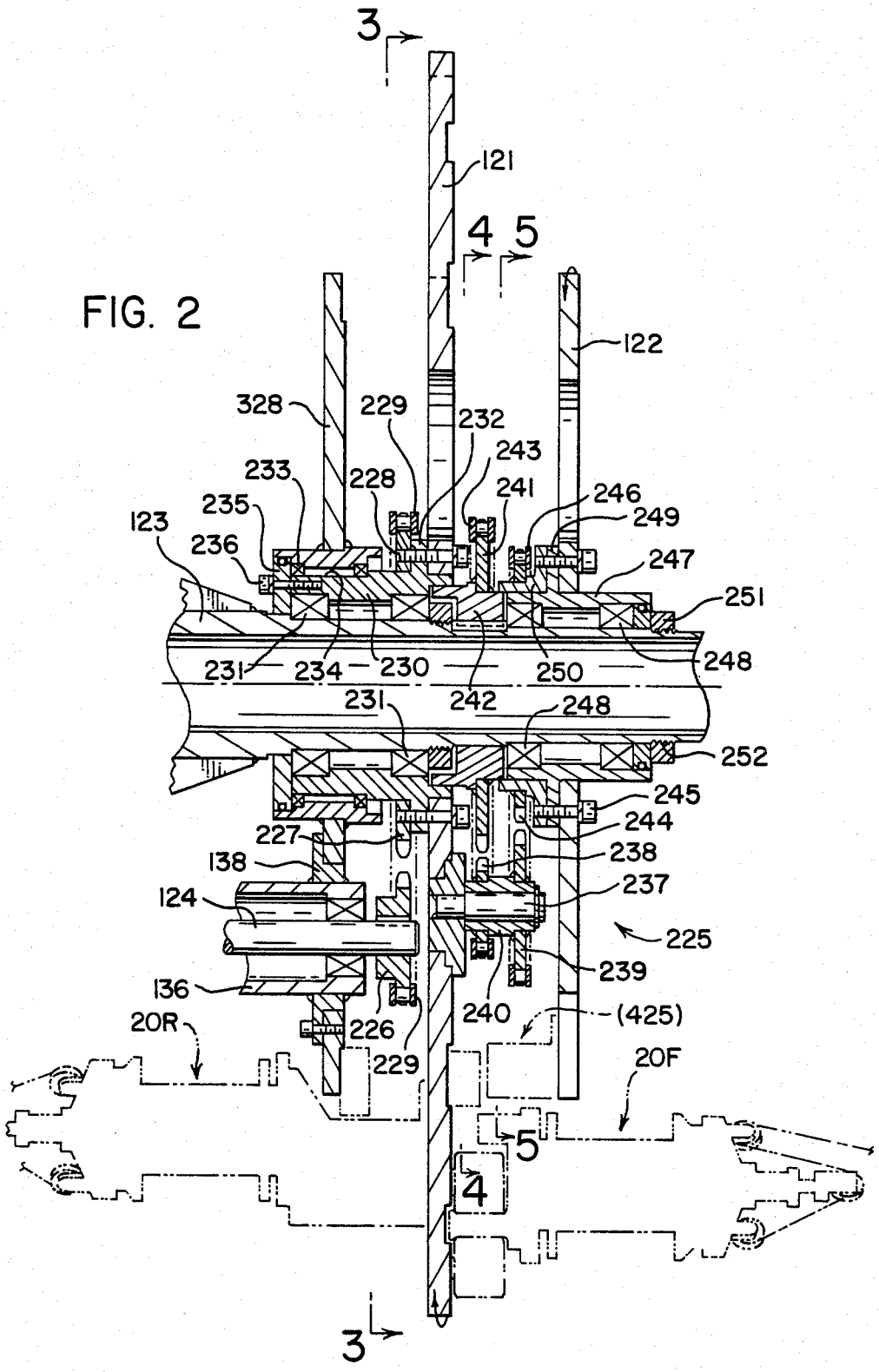
FIG. 2 is an enlarged side view, in section, showing details of a table drive mechanism according to the invention.
Figure 3:
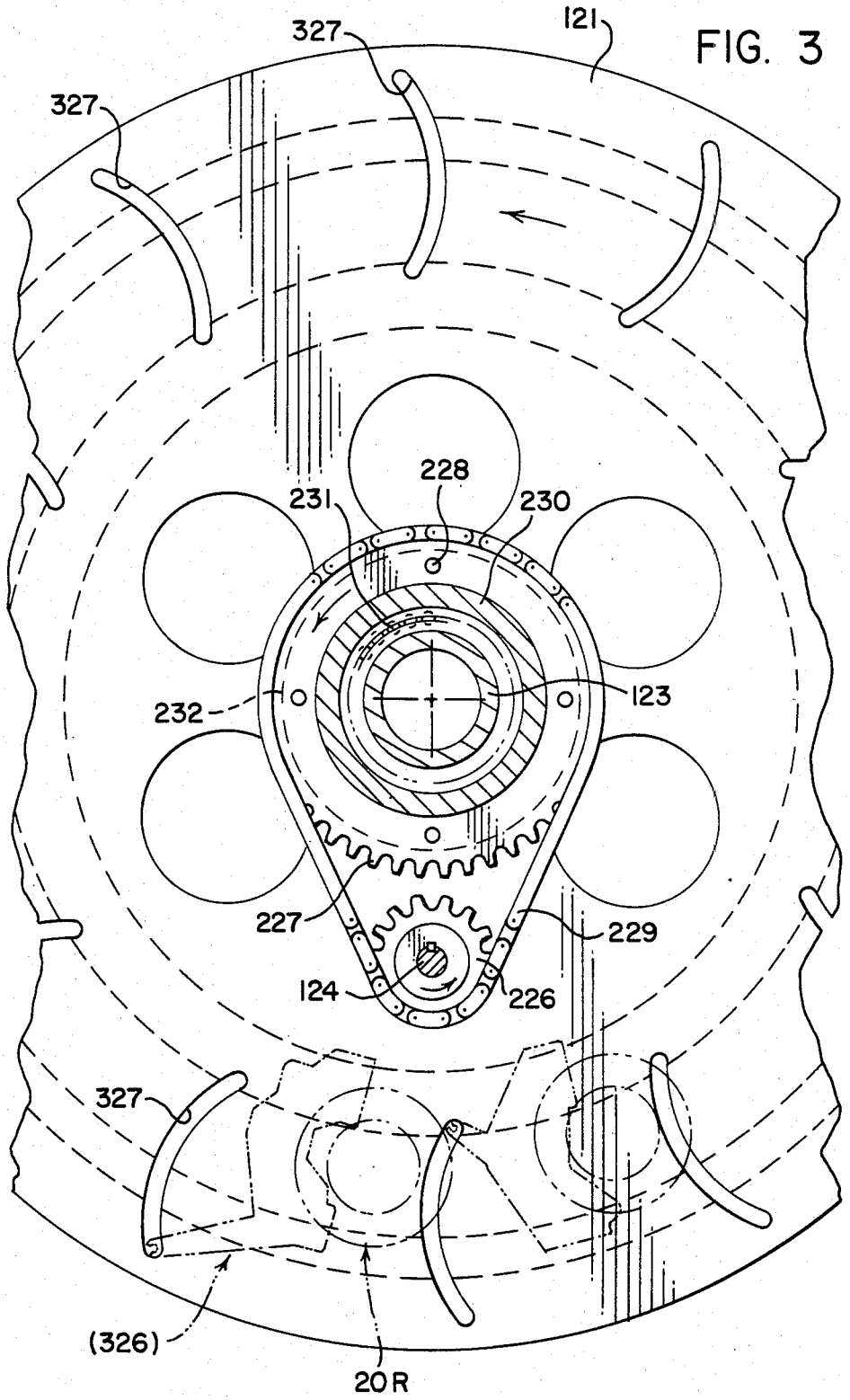
FIG. 3 is a fragmentary rear section, looking toward the first table, taken substantially as indicated on line 3—3 of FIG. 2.
Figure 4:
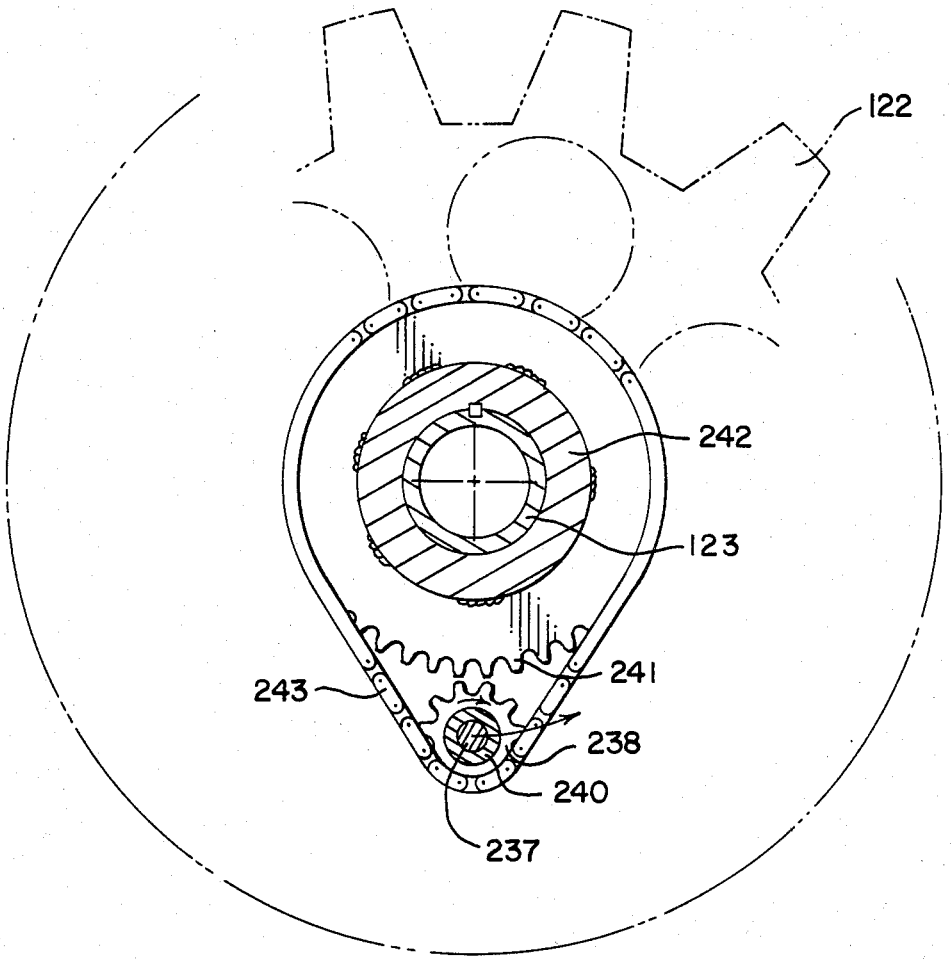
FIG. 4 is a full rear section taken substantially as indicated on line 4—4 of FIG. 2.
Figure 5:
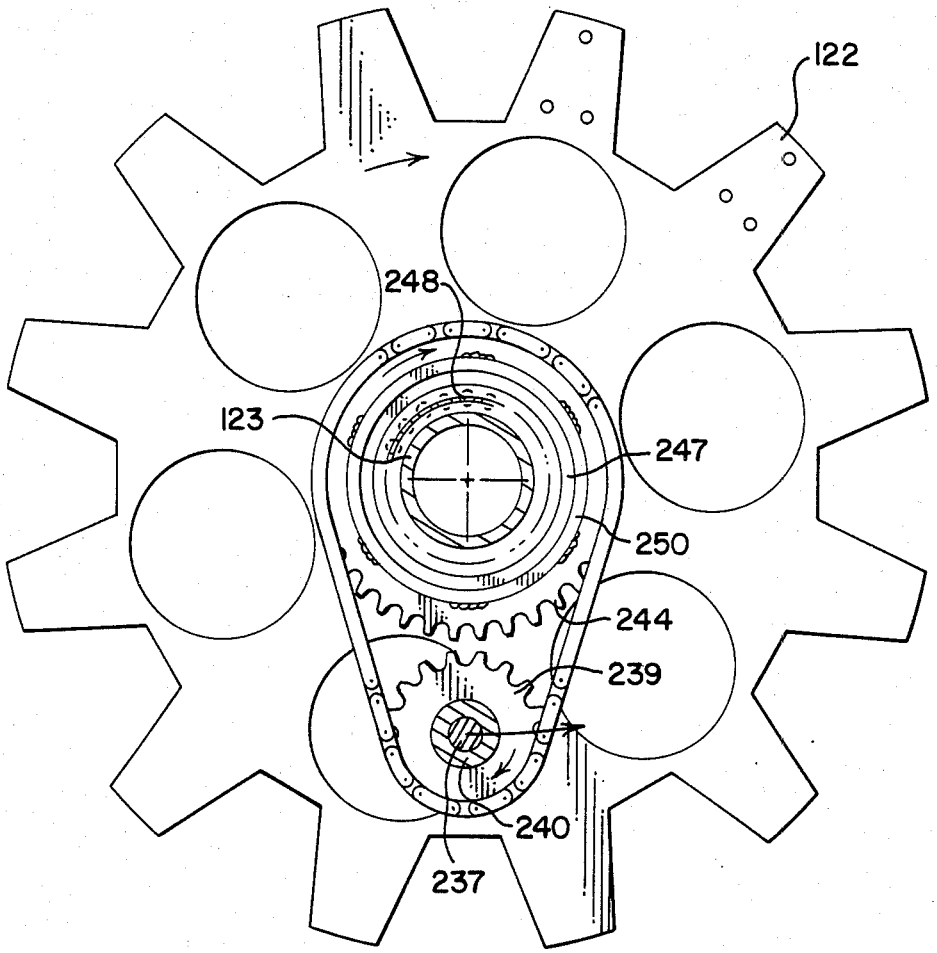
FIG. 5 is still another full rear section, looking toward the second table, taken substantially as indicated on line 5—5 of FIG. 2.

A horizontal braiding machine, embodying the present invention, is referred to generally by the numeral 120. The braiding machine 120 will have a set of rear carriers 20R for a strand supply bobbin mounted on the rear side of a first table 121 for rotation in one direction. The strands from bobbins on the rear carriers 20R pass through peripheral and radially arcuate slots 327 in the first table 121. The braiding machine 120 will further have a set of front carriers 20F for a strand supply bobbin movable around the front side of the first table 121 for rotation by a second table 122 in the opposite direction. A stationary shaft 123 on the central axis of the braiding machine rotatably mounts the first table 121 and second table 122 thereon. A drive mechanism power input shaft 124 extends substantially parallel to the stationary shaft 123 and toward the rear side of the first table 121.

A drive mechanism according to the invention, for selectively rotating the first table 121 and the second table 122 in opposite directions around the central axis stationary shaft 123, is referred to generally by the numeral 225. The table drive mechanism 225 is operable above a frame base 126 carrying a vertically oriented frame stanchion 127 for mounting the stationary shaft 123 and the power input shaft 124.

Each set of carriers for a strand supply bobbin, 20R and 20F, are shown only by chain lines. A carrier 20 particularly suited for use on a braiding machine 120 may be as disclosed in (Case No. 1795) U.S. patent appln. Ser. No. 648,064, filed Sept. 7, 1984, Bull et al, Carrier For A Strand Supply Bobbin. Reference is made to said patent application for such further details as may be required to more fully understand the nature of the invention.

A mounting assembly for the stationary shaft 123 and the power input shaft 124 is shown only by chain lines. A mounting assembly (125) particularly suited for use on a braiding machine 120 may be as disclosed in (Case No. 1794) U.S. patent appln. Ser. No. 673,382, filed Nov. 20, 1984, Bull, et al, Apparatus For Mounting Of Components For Rotation of Carriers for a Strand Supply Bobbin and for Timing Strand Movement Relative to Rotation. Reference is made to said patent application for such further details as may be required to more fully understand the nature of the invention.

A drive assembly for moving each front carrier 20F during rotation of the second table 122 is shown only by chain lines. A front strand carrier mounting and drive assembly (425) particularly suited for use on a braiding machine 120 may be as disclosed in (Case No. 1798) U.S. patent appln. Ser. No. 673,385, filed Nov. 20, 1984, Bull, et al, Apparatus For Rotating A Set Of Carriers For A Strand Supply Bobbin Relative To Moving Strands From A Set Of Contra-Rotating Carriers For A Strand Supply Bobbin. Reference is made to said patent application for such further details as may be required to more fully understand the nature of the invention.

The table drive mechanism 225 has a first sprocket 226 securely mounted on the forward end of the power input shaft 124 and behind the rear side of the first table 121. A second sprocket 227 is positioned coaxially around the central axis stationary shaft 123 and aligned with the first sprocket 226 and coupled to the first table 121, as by bolts 228. A first chain means 229 connects the first sprocket 226 with the second sprocket 227 so that a rotation of the power input shaft 124 will rotate the first table 121 in one direction.

As shown, a first journal sleeve 230 is positioned around the central axis stationary shaft 123. The journal sleeve 230 freely rotates on roller bearing assemblies 231. The front face of the journal sleeve 230 has an annular shoulder flange 232 for secure connection thereto of the first table 121 and the second sprocket 227, as by passthrough attachment of the bolts 228.

As shown, the rear face of the journal sleeve 230 carries a control element 328 which is securely connected, as indicated at 138, to the front end of a mounting assembly drive torque tube 136. The control element 328 is mounted on roller bearing assemblies 233 positioned within a circumferential bearing race 234 and is secured by an annular end retainer 235, attached to the journal sleeve 230 as by bolts 236.

Control element 328, positioned coaxially around the central axis stationary shaft 123 behind the rear side of the first table 121 and radially inwardly of the rear carriers 20R, is used with of a set of mechanisms (326) for guiding strands from bobbins on the rear carriers 20R through an arc segment relative to the central axis of the braiding machine 120 and inwardly and outwardly relative to moving strands (24F) from bobbins on the front carriers 20F. An embodiment of control element 328 and strand guiding components functioning in combination therewith may be as disclosed in (Case No. 1792) U.S. patent appln. Ser. No. 673,384, filed Nov. 20, 1984, Bull et al, Apparatus for Control of Moving Strands From Rotating Strand Supply Bobbins. Reference is made to said patent application for such further details as may be required to more fully understand the nature of the invention.

The drive mechanism 225 further has a post shaft 237 extending from the front side of the first table 121 and substantially parallel to the central axis stationary shaft 123 and toward the second table 122. A third sprocket 238 is positioned around the post shaft 237 on the medial portion thereof and rotatable thereon. A fourth sprocket 239 is positioned around the post shaft 237 on the end thereof and rotatable thereon. The third sprocket 238 and the fourth sprocket 239 are coupled together, as by mounting on a journal bushing 240 carried by the post shaft 237.

The drive mechanism 225 further has a fifth or "sun" sprocket 241 positioned around the central axis stationary shaft 123 and coupled or keyed thereto and aligned with the third sprocket 238. As shown, a coupler sleeve 242 in front of the journal sleeve 230 is secured to the stationary shaft 123 and the sun sprocket 241 is mounted thereon. A second chain means 243 connects the third sprocket 238 and the sun sprocket 241 so that the third sprocket 238 is rotated in a second direction during rotation of the first table 121 in the opposite direction.

The drive mechanism 225 further has a sixth sprocket 244 positioned around the central axis stationary shaft 123 and aligned with the fourth sprocket 239 and coupled to the second table 122, as by bolts 245. A third chain means 246 connects the fourth sprocket 239 with the sixth sprockets 244 so that the fourth sprocket 239, coupled to the third sprocket 238, and the second table 122 are rotated in a second direction during rotation of the first table 121 in the opposite direction.

As shown, a second journal sleeve 247 is positioned around the central axis stationary shaft 123 in front of the coupler sleeve 242. The journal sleeve 247 freely rotates on roller bearing assemblies 248. The face of the journal sleeve 247 has an annular shoulder flange 249 for secure connection thereto of the second table 122 and a ring flange 250 carrying the sixth sprocket 244, as by passthrough attachment of the bolts 245. The journal sleeve 247 is secured around the stationary shaft 123 by a bearing nut 251 having internal threads for mating engagement with external threads 252 on the stationary shaft 123.

What is claimed is:

1. In a braiding machine having a set of rear carriers for a strand supply bobbin mounted on the rear side of a first table for rotation in one direction, a set of front carriers for a strand supply bobbin movable around the front side of said first table for rotation by a second table in the opposite direction, a central axis stationary shaft for rotatable mounting of said first and second tables thereon, a drive mechanism power input shaft extending substantially parallel to said stationary shaft and toward the rear side of said first table, and a frame base carrying a vertically oriented frame stanchion for mounting said stationary shaft and said power input shaft, a drive mechanism for rotating said first and second tables in opposite directions, said table drive mechanism comprising:

a first sprocket mounted on the forward end of said power input shaft and behind the rear side of said first table;

a second sprocket positioned around said stationary shaft and aligned with said first sprocket and coupled to said first table;

a first chain means connecting said first sprocket with said second sprocket whereby a rotation of said power input shaft will rotate said first table in one direction;

a post shaft extending from the front side of said first table substantially parallel to said stationary shaft and toward said second table;

a third sprocket positioned around said post shaft on the medial portion thereof and rotatable thereon; a fourth sprocket positioned around said post shaft on the end thereof and coupled to said third sprocket for rotation thereof;

a fifth sprocket positioned around said stationary shaft and coupled thereto and aligned with said third sprocket;

a second chain means connecting said third sprocket with said fifth sprocket whereby said third sprocket is rotated in a second direction during rotation of said first table in the opposite direction;

a sixth sprocket positioned around said stationary shaft and aligned with said fourth sprocket and coupled to said second table; and, a third chain means connecting said fourth sprocket with said sixth sprocket whereby said fourth sprocket, coupled to said third sprocket, and said second table are rotated in a second direction during rotation of said first table in the opposite direction.

2. A braiding machine according to claim 1 which further has a control element positioned around said central axis stationary shaft and behind the rear side of said first table and radially inwardly of said set of rear carriers for a strand supply bobbin, and said table drive mechanism has a freely rotating first journal sleeve positioned around said stationary shaft and the rear face of said first journal sleeve carries said control element.

3. A table drive mechanism according to claim 2 wherein the front face of said first journal sleeve has an annular shoulder flange for connection thereto of said first table and said second sprocket.

4. A table drive mechanism according to claim 3 wherein a freely rotating second journal sleeve is positioned around said central axis stationary shaft and the face of said second journal sleeve has an annular shoulder flange for connection thereto of said second table and said sixth sprocket.

* * * * *